US005961179A

United States Patent [19]

Dixon et al.

[11] Patent Number: 5,961,179

[45] Date of Patent: Oct. 5, 1999

[54] OPERATOR-INTERACTIVE ADJUSTABLE WORKSTATION

[75] Inventors: Perry L. Dixon, Grand Rapids; Douglas M. Thole, Grandville; Robert T. Ritt, Holland, all of Mich.

[73] Assignee: Haworth, Inc., Holland, Mich.

[21] Appl. No.: 08/870,130

[22] Filed: Jun. 6, 1997

[51] Int. Cl.[6] ..... A47B 39/02

[52] U.S. Cl. ..... 297/173; 297/156; 297/169; 297/195.11; 297/423.11; 297/423.12; 297/300.3; 297/302.2; 297/463.1; 297/174

[58] Field of Search ..... 297/173, 156, 297/161, 169, 337, 338, 195.11, 215.13, 423.11, 423.12, 300.3, 382.2, 463.1, 174

[56] References Cited

U.S. PATENT DOCUMENTS

| | | | |
|---|---|---|---|
| 121,070 | 11/1871 | Watson . | |
| 2,208,945 | 7/1940 | Miller | 297/170 |
| 3,034,824 | 5/1962 | Rassier | 297/170 |
| 4,650,249 | 3/1987 | Serber . | |
| 4,779,922 | 10/1988 | Cooper . | |
| 4,798,411 | 1/1989 | Lin | 297/174 |
| 4,872,696 | 10/1989 | Gill | 297/215.13 X |
| 4,880,271 | 11/1989 | Cooper . | |
| 4,915,450 | 4/1990 | Cooper . | |
| 5,054,852 | 10/1991 | Tholkes | 297/423.12 X |
| 5,056,864 | 10/1991 | Cooper . | |
| 5,098,160 | 3/1992 | Moore et al. . | |
| 5,161,766 | 11/1992 | Arima | 297/174 X |
| 5,174,224 | 12/1992 | Nagy et al. | 108/114 |
| 5,186,519 | 2/1993 | Larson | 297/423.12 |
| 5,330,254 | 7/1994 | Larson | 297/338 X |
| 5,401,078 | 3/1995 | Riach . | |
| 5,487,590 | 1/1996 | Haynes | 297/338 X |
| 5,540,160 | 7/1996 | Rea | 297/423.11 |
| 5,542,746 | 8/1996 | Bujaryn | 297/423 |
| 5,582,464 | 12/1996 | Maymon | 297/173 X |
| 5,619,949 | 4/1997 | Dick, Jr. | 297/338 X |
| 5,667,278 | 9/1997 | Li | 297/423.12 X |
| 5,820,208 | 10/1998 | Miklinwich | 297/170 X |

FOREIGN PATENT DOCUMENTS

| | | | |
|---|---|---|---|
| 982637 | 6/1951 | France | 297/170 |
| 1292488 | of 1962 | France | 297/174 |
| 848554 | 7/1952 | Germany | 297/170 |
| 41 05 372 | 1/1992 | Germany . | |
| 144262 | 12/1990 | Switzerland | 297/174 |

*Primary Examiner*—Peter M. Cuomo
*Assistant Examiner*—Rodney B. White
*Attorney, Agent, or Firm*—Flynn, Thiel, Boutell & Tanis, P.C.

[57] ABSTRACT

An operator-interactive adjustable workstation including a support frame, a seat adapted for engagement with an operator, and a worksurface having an enlarged upper surface. A motion connecting structure connects between the frame, seat and worksurface for permitting the positions of the seat and worksurface to be simultaneously adjusted relative to the frame. An operator-interactive structure interconnects to the connecting structure for controlling position-adjusting movement of the seat and worksurface in response to an operator-imposed controlling force. A manually-releasable brake cooperates with the connecting structure for normally maintaining it in a fixed positional relationship to define stationary positions for the seat and worksurface.

14 Claims, 7 Drawing Sheets

OPERATOR-INTERACTIVE ADJUSTABLE WORKSTATION

FIELD OF THE INVENTION

This invention relates to a workstation employing a seat and worksurface which are each positionably adjustable and, more particularly, to an improved operator-interactive adjustable workstation which permits the operator to easily interact, as by means of a foot support, with a mechanism which supports the seat and worksurface so as to readily permit changing in the position thereof, such as changing the heights between seating and generally standing positions.

BACKGROUND OF THE INVENTION

Workstations employing an interrelated worksurface and seat are well known, and such workstations have generally permitted the worksurface and/or the seat to be adjusted in height. The height adjustment, however, has traditionally been manual and individual, that is, the worksurface and/or seat is adjustable in height independent of the other, and the adjustment normally can be accomplished only when the operator is not seated at the workstation since the height adjustment mechanism traditionally is conveniently adjustable only when the weight of the operator is removed from the workstation. Further, most of these workstations, even those employing height adjustment, generally permit such adjustment through only a limited extent, and often do not conveniently permit height adjustment through a sufficient range to accommodate the operator in either a sitting or standing position. These known workstations also typically do not provide for an interrelated and simultaneous adjustment in the position (i.e. height) of both the worksurface and seat, and particularly do not permit such adjustment due to physical interaction of the operator while in a seated or workstation-occupying position.

Accordingly, it is an object of this invention to provide an improved adjustable workstation which is believed to overcome many of the aforementioned disadvantages.

More specifically, this invention relates to an improved adjustable workstation employing a seat and a worksurface which are each height adjustable, with the seat and worksurface being interconnected by an appropriate connecting structure, such as a linkage or mechanism, which actively interacts with the workstation operator (i.e. occupant) so that the operator can readily and simultaneously adjust the height of both the seat and worksurface due to physical interaction of the operator with the connecting structure, while the operator is occupying or utilizing the workstation, to thus permit the operator to quickly and readily vary the height through a significant range to thus vary the ergonomic positional relationships and accommodate use of the workstation from various seating positions up to and including a standing position.

In the improved operator-interactive workstation of this invention, the workstation includes a supporting frame provided with a linkage thereon including a first vertically movable support member which mounts a seat, and a second vertically movable support member which mounts a worksurface. These supporting members are appropriately interconnected so as to simultaneously move generally vertically upwardly or downwardly when the linkage is activated by the operator. The linkage includes an operator-reactive member, such as a foot support, which can be controlled by the feet of the operator to permit the height of the worksurface and seat to be simultaneously adjusted, either upwardly or downwardly, while the operator remains seated. The workstation includes a manually-releasable brake which cooperates to lock the linkage, and hence lock the seat and worksurface, in a selected position. This brake is manually released by the operator, who in turn adjusts the linkage through interaction with the foot support when adjustment in the position or height of the workstation is desired.

In the improved operator-interactive workstation of this invention, as aforesaid, there is also preferably provided an adjusting structure which cooperates with the worksurface to permit the position thereof, particularly the front-to-back horizontal position thereof relative to the seat, to be selectively adjusted by the operator. This adjustment mechanism includes a releasable brake structure which normally locks the worksurface in a first front-to-back position relative to the seat, with this latter brake structure being manually releasable by the operator to permit the position of the worksurface to be adjusted relative to the seat, in accordance with the desired positional relationship of the operator.

Other structural and operational advantages of the workstation according to the present invention will be apparent to persons familiar with structures of this general type upon reading the following specification and inspecting the accompanying drawings.

Figure 1:
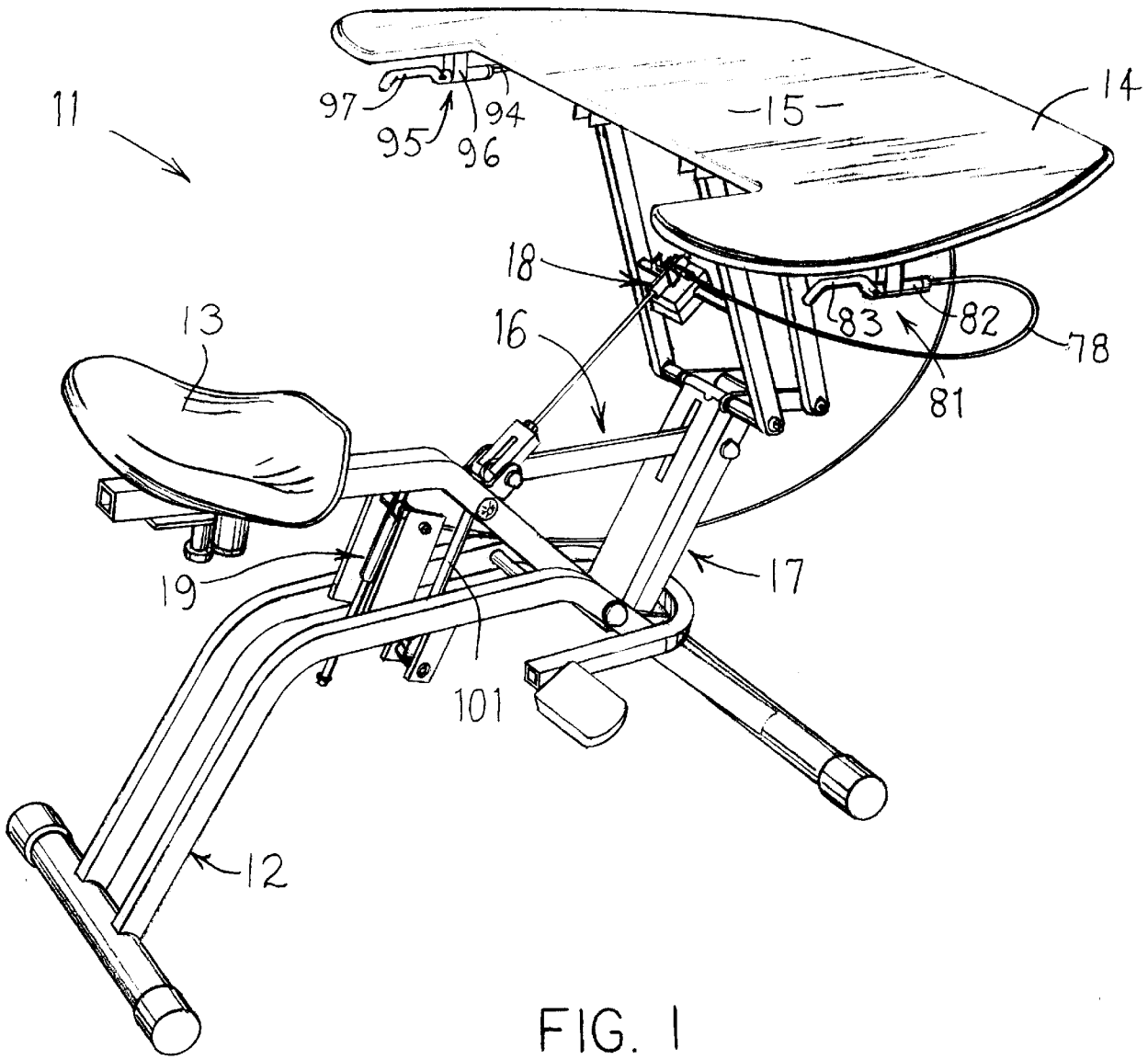
FIG. 1 is a perspective view of a first embodiment of an operator-interactive adjustable workstation according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "upwardly" and "downwardly" will also be used to refer to movement of the seat and worksurface as they are being moved respectively toward raised or lowered positions. The words "forwardly" and "rearwardly" will be used to refer to movement of the worksurface respectively horizontally away from or toward the seat, the "forward" movement of the worksurface being from the solid line to the dotted line position in FIG. 2, and the "rearward" movement being the reverse thereof. The words "inwardly" and "outwardly" will refer to directions toward and away from, respectively, the geometric center of the overall apparatus and designated parts thereof. Said terminology will include the words specifically mentioned, derivatives thereof, and words of similar import.

DETAILED DESCRIPTION

Referring to the drawings and specifically FIGS. 1–5, there is illustrated a first embodiment of a operator-interactive adjustable workstation 11 according to the present invention. This workstation 11 includes a frame 12 on which a seat 13 and a worksurface 14 are provided, the latter having a generally enlarged and substantially planar upper surface 15 which is normally oriented at least approximately horizontally.

The workstation 11 includes a movement connecting structure 16 which connects the seat 13 and worksurface 14 to one another and to the frame 12. An operator-reactive structure 17 joins to the connecting structure 16 to control movement of the seat 13 and worksurface 14. A manually-controlled position adjusting arrangement 18 cooperates with part of the connecting structure 16 to permit selective adjustable positioning of the worksurface 14 relative to the seat 13. A manually-releasable braking or holding arrangement 19 also cooperates with the connecting structure 16 to permit the connecting structure 16, and the seat 13 and worksurface 14 carried thereby, to be stationarily held in a selective position either at the extreme ends of the range of movement, or at any location therebetween.

The specific structure of the workstation 11, and the structural and functional relationships of the parts thereof as briefly summarized above, will now be explained in greater detail.

Considering first the frame 12, it includes a horizontally elongate intermediate frame part or beam 21 which adjacent opposite ends is joined to respective front and rear support legs 22 and 23 which project downwardly and, at lower ends thereof, are provided with transversely projecting stabilizing feet 24 adapted for supportive engagement with a floor. A postlike member or upright 26 is fixed to and cantilevered vertically upwardly from the intermediate beam 21 adjacent the forward end thereof. This upwardly cantilevered upright 26, adjacent the upper end thereof, is fixedly provided with a forwardly cantilevered top arm 27.

To movably support the seat 13 on the frame 12, the movement connecting structure 16 includes an elongate seat support member 31 formed generally as an elongate lever and connected adjacent its front end by a generally transverse horizontal hinge or pivot 32 to the intermediate frame part 21 adjacent the forward end thereof. This seat support member 31 is thus supported for swinging movement about the hinge 32 within a generally longitudinally-extending vertical plane. The seat support member 31 defines a generally horizontally elongate beam part 33 which projects inwardly from the free end of the seat support member. The seat 13 is supported on this beam part 33 and includes a bracket 34 on the underside thereof which is adjustably slidably supported for displacement longitudinally along the beam part 33. The bracket 34 has a suitable locking or fixing member 35 which enables the seat to be fixed to the beam part 33 at a desired location.

The movement connecting structure 16 also includes a worksurface supporting arrangement 41 which mounts thereon the worksurface 14 and provides for swinging movement thereof generally within a longitudinally-extending vertical plane. This supporting arrangement 41 includes a sidewardly-spaced pair of vertically elongate first support members 42 which are disposed adjacent but rearwardly of a second pair of sidewardly-spaced vertically elongate second support members 43. The first or rear support members 42 are formed generally as elongate levers and have the lower ends joined by a transverse horizontal pivot or hinge 44 to the top of the upright 26. The upper ends of these levers 42 are joined by a transverse horizontal pivot or hinge 45 to brackets 46, the latter being fixed to the underside of the worksurface 15. The pair of front support members 43 are similarly supported in that the lower ends are joined by a transverse horizontal hinge 47 to the top arm 27, and the upper ends of these levers 43 are joined by a transverse horizontal hinge 48 to the brackets 46. The brackets 46 are preferably elongated in the front-to-back direction of the worksurface, and are provided with a plurality of openings therethrough so that the upper hinges 45 and 48 can be positioned in different openings, depending upon the desired mounting position of the worksurface.

Figure 2:
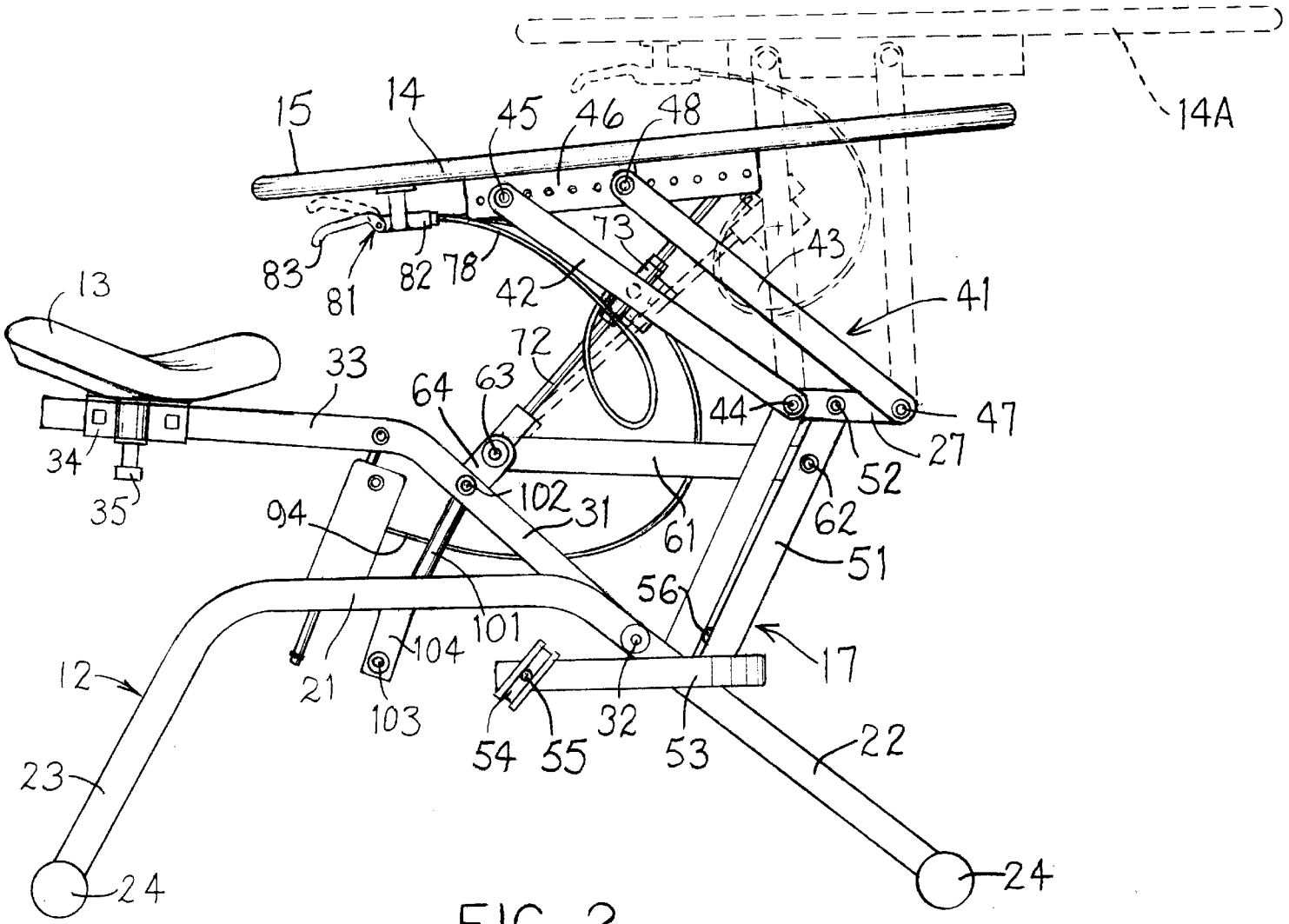
FIG. 2 is a side elevational view of the workstation shown in FIG. 1, with the seat and worksurface being shown in a lower position, and with the worksurface being shown in dotted lines in a forwardly-adjusted position relative to the seat.
Figure 3:
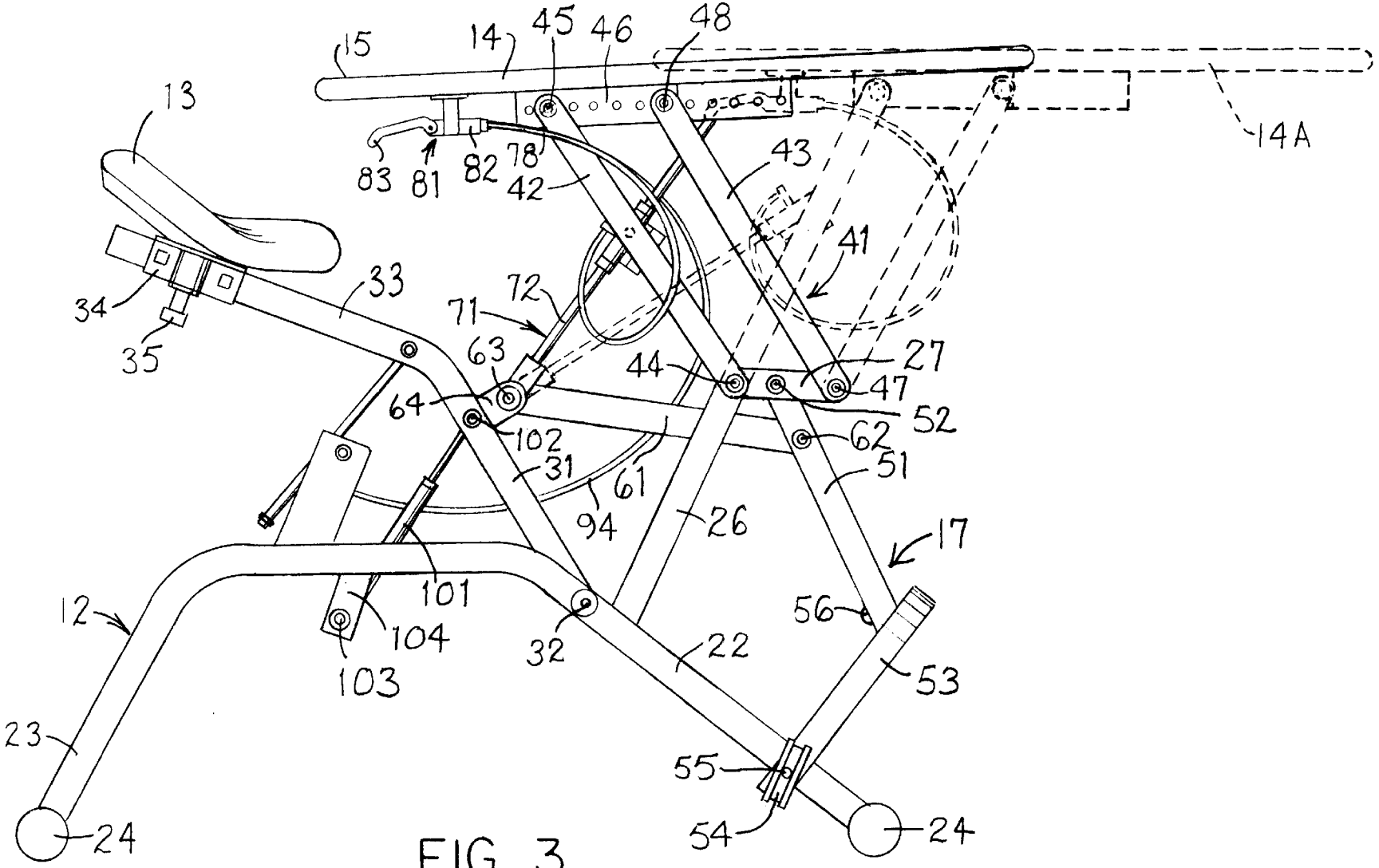
FIG. 3 is a side elevational view similar to FIG. 2 but showing the seat and worksurface of the workstation in a raised position, and with the worksurface being shown in dotted lines in a forwardly-adjusted position relative to the seat.
Figure 4:
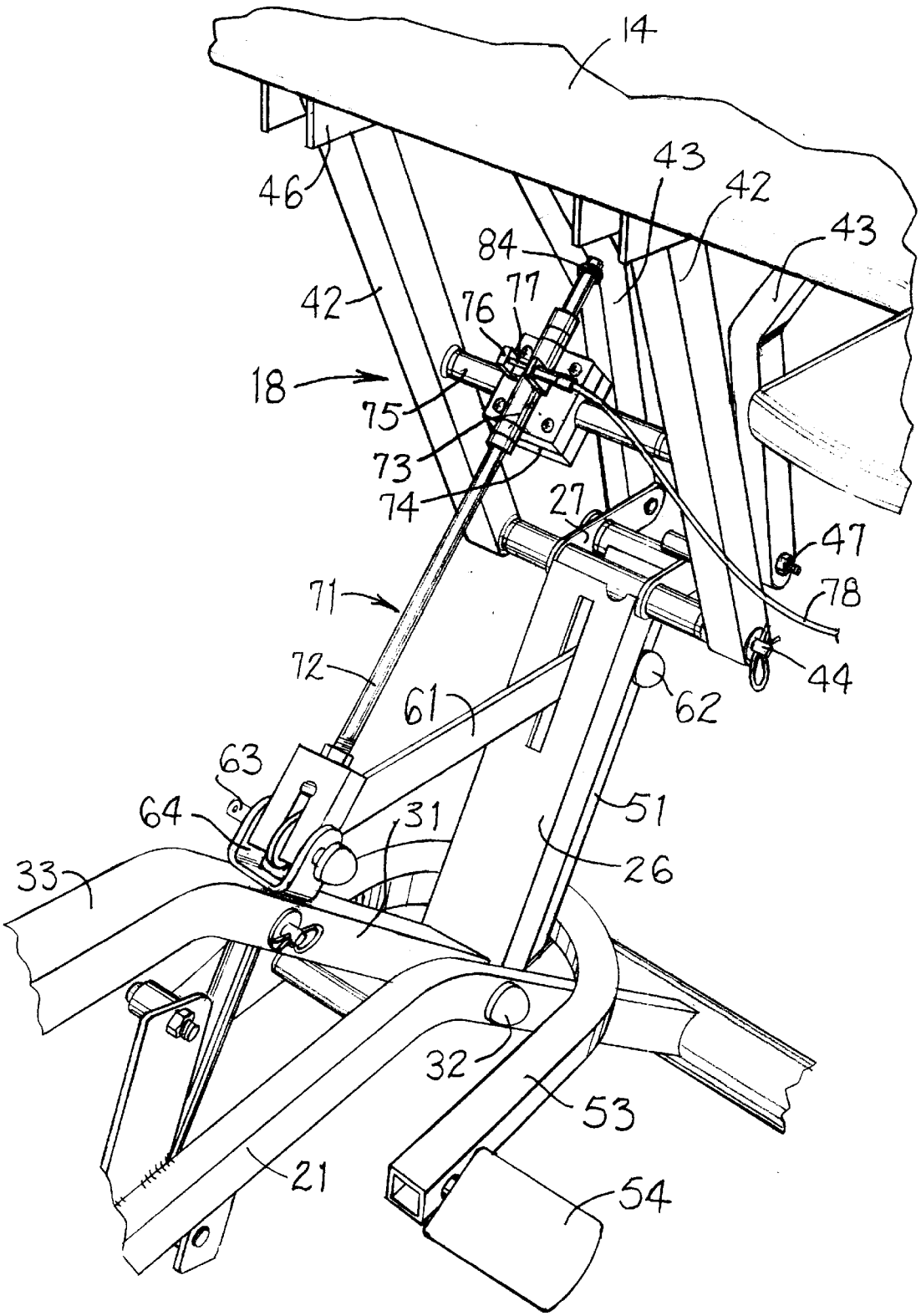
FIG. 4 is an enlarged, fragmentary perspective view which illustrates the brake as connected between the movable seat support member and the frame.

As illustrated by FIGS. 2 and 3, the front and rear support members 42 and 43 extend upwardly in approximately parallel relation, and the upper and lower hinges 44–45 and 47–48 all extend in generally parallel relationship and define a four-bar linkage which closely approximates a parallelogram so that vertical swinging of the worksurface supporting arrangement 41 does not cause any significant change in the angularity of the worksurface 15.

To provide for operator control over the movement of the connecting structure 16, the latter is interconnected to the operator-reactive structure 17 which, as illustrated by FIGS. 2 and 3, includes an elongate connecting arm or lever 51 which, at its upper end, is joined to the frame top arm 27 by a transverse horizontal pivot or hinge 52, the latter being generally parallel with and positioned generally between the bottom or lower pivots 44 and 47. The connecting arm 51 is cantilevered downwardly from the top pivot 52 and, adjacent its lower end, is provided with a lower arm 53 which is fixed thereto and cantilevered rearwardly therefrom. This lower arm 53, in the illustrated embodiment, is generally U-shaped and, adjacent the rear free ends of the legs thereof, is provided with foot supports 54 for engagement with the feet of the operator. These foot supports 54 can be similar to pedals, and for this purpose can be mounted from the lower arm 53 by transverse horizontal pivots or hinges 55.

The connecting arm 51, on the rear side adjacent the lower end thereof, is provided with a rearwardly projecting stop 56, normally of a rather hard elastomeric material. This stop is adapted to abut against the front surface of the frame upright 26 to limit the downward and rearward swinging of the connecting arm 51, and thus define the lowermost position of the workstation substantially as indicated by solid lines in FIG. 2.

The structure and connection of the operator-reactive structure 17, and specifically the positioning of the foot supports 54, is such that these supports 54 are disposed downwardly and forwardly of the seat 13, and likewise these foot supports 54 are disposed downwardly below the worksurface and are generally positioned approximately under the worksurface. Thus, an operator seating on seat 13 can comfortably position his/her feet on the foot supports 54 to permit interactive engagement and activation thereof, when desired, as explained hereinafter.

The movement connecting structure 16 includes a first elongate connecting link 61 which at a forward end is joined by a transverse horizontal hinge or pivot 62 to the connecting arm 51. The hinge 62 is spaced downwardly at least a limited extent away from the upper arm pivot 52. The connecting link 61 is elongated rearwardly and, at its rearward end, is joined to the seat support member 31 by a further transverse horizontal hinge or pivot 63. The latter is, in the illustrated embodiment, joined directly to a bracket 64 which, in turn, is fixed to the seat support member 31 at a location disposed intermediate and approximately midway between the seat 13 and the front hinge 32.

The motion connecting structure 16 also includes a connecting link arrangement 71 (FIG. 4) for creating a pivotal and adjustable connection between the seat support member 31 and the worksurface-supporting arrangement 41. This connecting link arrangement 71 includes an elongate connecting link 72 which is formed substantially as an elongate rod and which, at its rearward end, has fixed thereto a forklike structure 79 which is pivotally joined to the transverse horizontal pivot 63. The connecting rod 72, intermediate the length thereof, is engaged in and extends through a tubular housing 73, the latter being rigidly joined to a split bearing block 74. The bearing block 74 in turn is pivotally supported on a cross or pivot shaft 75 which extends between and is joined to the pair of sidewardly-spaced rear support levers 42, whereby this pivot shaft 75 defines a transverse horizontal pivot. This pivot shaft 75 is located generally intermediate the upper and lower ends of the rear support levers 42.

The tubular housing 73 defines therein a clamplike brake member (not shown) in surrounding relationship to the connecting rod 72, which brake member is normally disposed in frictional braking engagement with the connecting link 72 to prevent longitudinal movement thereof. The braking member includes a tab 76 which projects outwardly and is joined to the free end of an elongate flexible control cable 77, the latter being slidably supported within a conventional flexible sheath 78. The flexible control cable/sheath 77–78 projects upwardly under the worksurface and joins to an actuator 81 which is mounted adjacent the worksurface, such as adjacent the underside thereof in the vicinity of one front corner. The actuator 81 includes a support bracket 82 which is fixed to the worksurface and which also fixedly engages the remote end of the sheath 78. The control cable 77 in turn couples to a pivotal release lever 83 such that, when the operator manually displaces the lever upwardly as indicated by the dotted line position in FIG. 2, this thus releases the brake to enable the control rod 72 to be slidably move forwardly or rearwardly relative to the tubular housing 73 to thus adjust the position of the worksurface 14 relative to the seat 13. Such adjustment is indicated by the solid and dotted line positions of the worksurface in FIGS. 2 and 3. When the worksurface 14 is in the desired position, the actuator 81 is released, and an internal spring (not shown) returns the lever and control cable to their original positions, and thus causes the brake to again engage and stationarily hold the control rod 72.

The free end of the control rod 72 is provided with a suitable enlargement 84 thereon which functions as a stop to prevent the rod 72 from being withdrawn from the tubular housing 73, and thus define the forwardmost adjusted position of the worksurface 14.

Figure 5:
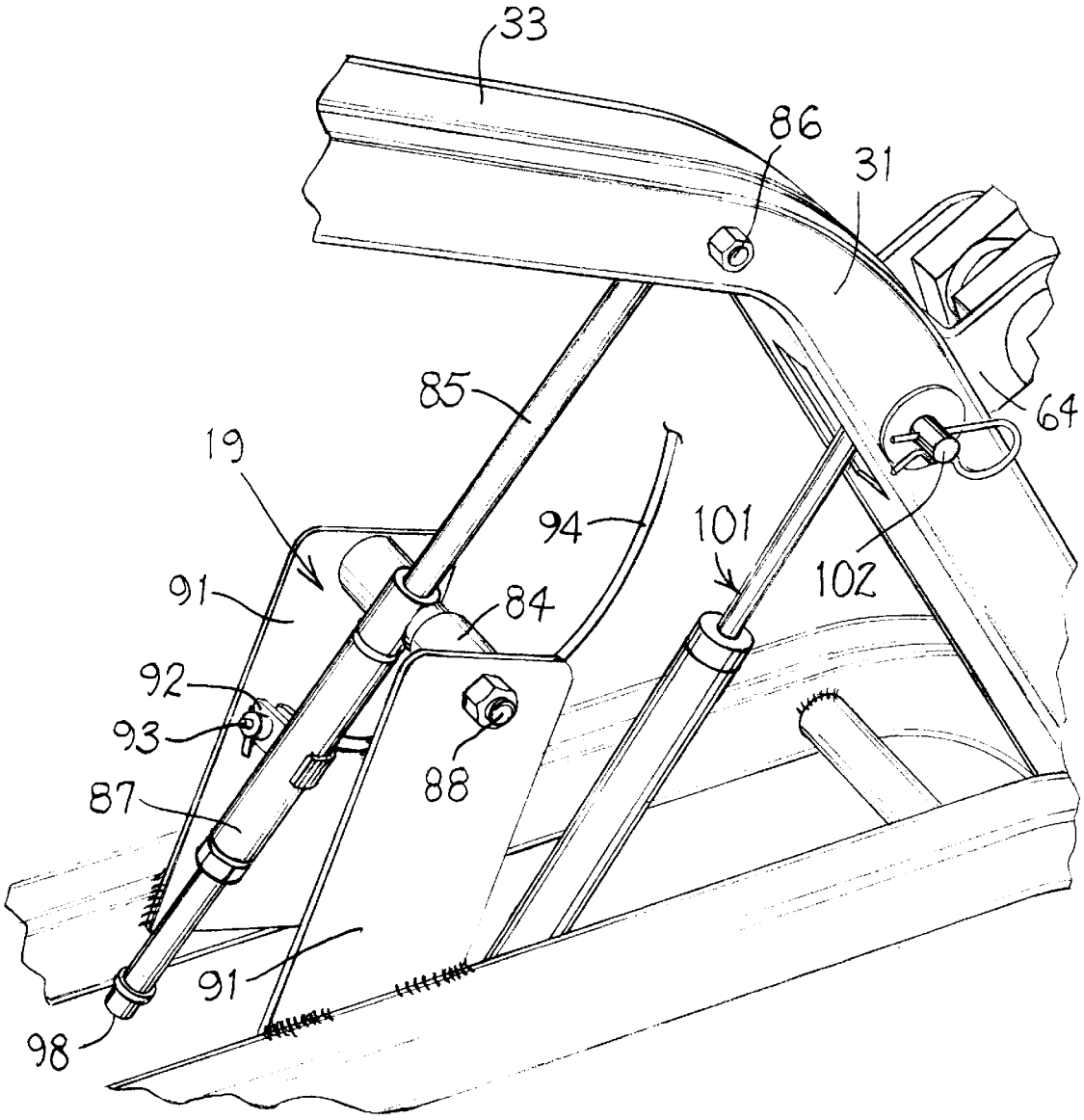
FIG. 5 is an enlarged, fragmentary perspective view which illustrates the adjustable connecting linkage between the movable seat-supporting and worksurface-supporting members, and specifically illustrating the releasable brake which cooperates therewith to adjust the position of the worksurface.

Considering now the braking or holding arrangement 19 and, referring specifically to FIG. 5, this braking arrangement cooperates directly between the swingable seat support member 31 and the intermediate beam 21 of the frame. The braking arrangement 19 includes an elongate control link 85 formed generally as a rod which, at its upper end, is joined to the pivotal seat support member 31 by a transverse horizontal hinge 86, the latter being in the vicinity of the forward end of the elongate beam part 33 but being spaced a significant distance from the horizontal hinge 32. The control rod 85 projects through a tubular housing 87 which has a horizontally transverse cross shaft 88 fixed thereto, the latter being rotatably supported in bearings 89 which in turn are fixed to a pair of side brackets 91. These brackets 91 in turn are fixed to and project upwardly from the frame member 21.

The tubular housing 87 has a releasable brake member therein (not shown) for cooperation with the control rod 85, which brake member, as described above relative to the position adjusting arrangement 18, includes a projecting tab 92 coupled to a control cable 93 which is slidably supported within a sheath 94. The opposite end of the control cable/sheath 93/94 connects to an actuator 95 which is also, in the illustrated embodiment, mounted on the underside of the worksurface 14 adjacent one of the front corners thereof, normally the opposite corner from the actuator 81. The actuator 95 is similar to the actuator 81 in that it includes a bracket 96 fixed to the worksurface and connected to the sheath. The bracket 96 pivotally mounts a manually-swingable lever 97 which couples to the control cable. This actuator 95 also includes a spring (not shown) for normally maintaining the actuator and control cable in the braking or holding position.

The lower free end of the control rod 85 has an enlargement or stop 98 thereon for controlling the uppermost position of the swingable seat support member 31.

The construction of the position adjusting arrangement 18 and braking or holding arrangement 19, namely the construction of the tubular housing and the cooperation of the internal braking member with the respective control rod, is conventional and is commercially available. One such structure is manufactured by P.L. Porter Company, Woodland Hills, Calif., and is sometimes known as a Porter lock.

When it is desired to adjust the positional relationships of the seat 13 and worksurface 14, specifically the heights thereof, then the operator manually releases the actuator 95 so as to release the control rod 85, whereby the movement connecting structure 16 is free to move so that the seat and worksurface can be simultaneously swingably moved between lowered positions as illustrated in FIG. 2, and raised positions as indicated by FIG. 3. The seat 13 and worksurface 14 can be locked at either of these positions, or at any position therebetween, merely by manually releasing the actuator 95 to effectively fix or lock up the connecting structure 16.

To provide for control over downward movement of the seat 13, particularly when the operator is seated thereon, a damping or cushioning cylinder 101 is connected between the swingable seat support member 31 and the frame 21. This cushioning cylinder is a conventional double-acting fluid pressure cylinder, such as an air cylinder. The upper end of this cylinder 101, namely the upper end of the extendable piston rod in the illustrated embodiment, is joined to the swingable seat support member 31 by a transverse horizontal hinge 102. This latter hinge is disposed adjacent but somewhat forwardly from the hinge 86, but is still spaced a significant distance from the main hinge 32 of the seat support member 31. The other end of the cushioning cylinder 101, namely the lower end of the cylindrical housing, is joined by a transverse horizontal hinge 103 to a pair of brackets 104, the latter being fixed to the frame beam 21.

The position of the brake control rod 85 and the cushioning cylinder 101 is such that, as illustrated by FIGS. 2 and 3, the line of action (i.e., line of force) extends at a significant transverse angle relative to the swingable seat support member as it projects away from its main front pivot 32, whereby the brake control member 82 and the cushioning cylinder 101 thus apply a force in generally transverse relation to the swingable seat support member 31, and this force in turn is effective over a significant lever arm as defined from the main front pivot 32.

The position adjusting control rod 72, as illustrated by the positions indicated in FIGS. 2 and 3, similarly extends in significantly transverse relation relative to the rear support link 42 to thus provide optimum force and effectiveness with respect to positionally adjusting the worksurface 14 between the positions indicated by solid and dotted lines.

In the description presented above, the many hinge or pivot points which have been described as transverse horizontal hinges will be understood to refer to hinge axes which extend horizontally in generally perpendicular relation with respect to a longitudinally-extending vertical plane, the latter extending in generally perpendicular relation to the upper surface of the worksurface.

The use and operation of the operator-interactive workstation 11 according to the present invention will now be briefly described with reference to FIGS. 1–5 to ensure a complete understanding thereof.

With the workstation 11 initially in a lowermost position generally as indicated in FIG. 2, the operator can be seated on the seat 13 and, due to the position of the worksurface 14, both due to its lowness and its close proximity to the seat, the operator can easily access and work on the upper surface of the worksurface. During this activity, the operator's feet can rest either on the floor, or on the foot support pedals 54 if desired.

If the worksurface 14 is closer to the operator than desired, then the operator can manually grip and release the actuator 81 to cause release of the position adjusting device 18. The operator, by gripping the edge of the worksurface 14, can then manually swing the worksurface away from the seat, such as into a forward position substantially as illustrated by dotted lines in FIG. 2. When the operator releases the actuator 81, this relocks the position adjusting device 18 and hence securely holds the worksurface in the adjusted position.

With the worksurface in the position indicated by FIG. 2, the entire movement connecting structure 16 is basically held stationary or fixed due to the engagement of the brake holding device 19. The only permissible movement in this locked condition is the adjustment of the worksurface, as explained above, which occurs through release of the position adjusting mechanism 18.

If the operator wishes to actively interact with the workstation so as to change the ergonomic position thereof, then the operator will first position his feet on the support pedals 54 and will preferably maintain a force engaging relationship therewith. The operator will then manually engage and release the other actuator 95, which in turn releases the braking arrangement 19. With the braking arrangement 19 maintained in a release condition, the operator can then apply a forward pushing force to the pedals 54 by extending his/her legs. This causes the reactive structure 17 to swing forwardly about the hinge 52 such as to a forward position as indicated by FIG. 3. During the forward swinging movement of the connecting arm 51, the connecting link 61 is pulled forwardly causing the seat support lever 31 and hence the seat 13 to be swingable moved upwardly. At the same time the hinge 62 is moved forwardly and upwardly, and thus acts through the connecting link arrangement 72 onto the rearwardmost support levers 42, causing the latter to swing forwardly so that the worksurface 14 is swung upwardly and forwardly simultaneous with the upward swinging of the seat 13. Once the desired new position of the workstation has been achieved, the operator then releases the actuator 95 so that the braking arrangement 19 again locks the movement control structure 16 in the new position, and thereafter the operator's foot pressure can be relieved from the foot supports 54.

In this new position, the operator can assume a different positional relationship with respect to the seat and worksurface, and also with respect to his legs, thereby providing for more variable ergonomic working positions. Further, by enabling the worksurface to be raised, it is possible for the operator to effectively stand or in the alternative lean against the front edge of the seat to permit use of the workstation at an increased height which enables the operator to more fully utilize his legs for supports when in this working position. In this raised position, the operator can again adjust the worksurface forwardly relative to the seat, such as indicated by dotted lines in FIG. 3, to permit standing adjacent the worksurface without encountering any significant interference with the seat.

With the workstation as described above, it will be appreciated that the operator can quickly, efficiently and frequently change the positional relationships of the seat and worksurface with respect to one another, and with respect to the floor, and thereby provide for frequent change in ergonomic positioning of the operator's body. Such ease of movement and working conditions is believed to be highly desirable, particularly since the movement utilizes forces generated by the operator's arms and/or legs so as to permit the desired position adjustment to take place.

It will be recognized that the configurations illustrated in the drawings for the seat 13 and worksurface 14 are merely exemplary, and that many different seat and worksurface configurations can be provided and still structurally and functionally cooperate in accordance with the operator-interactive workstation of this invention.

Figure 6:
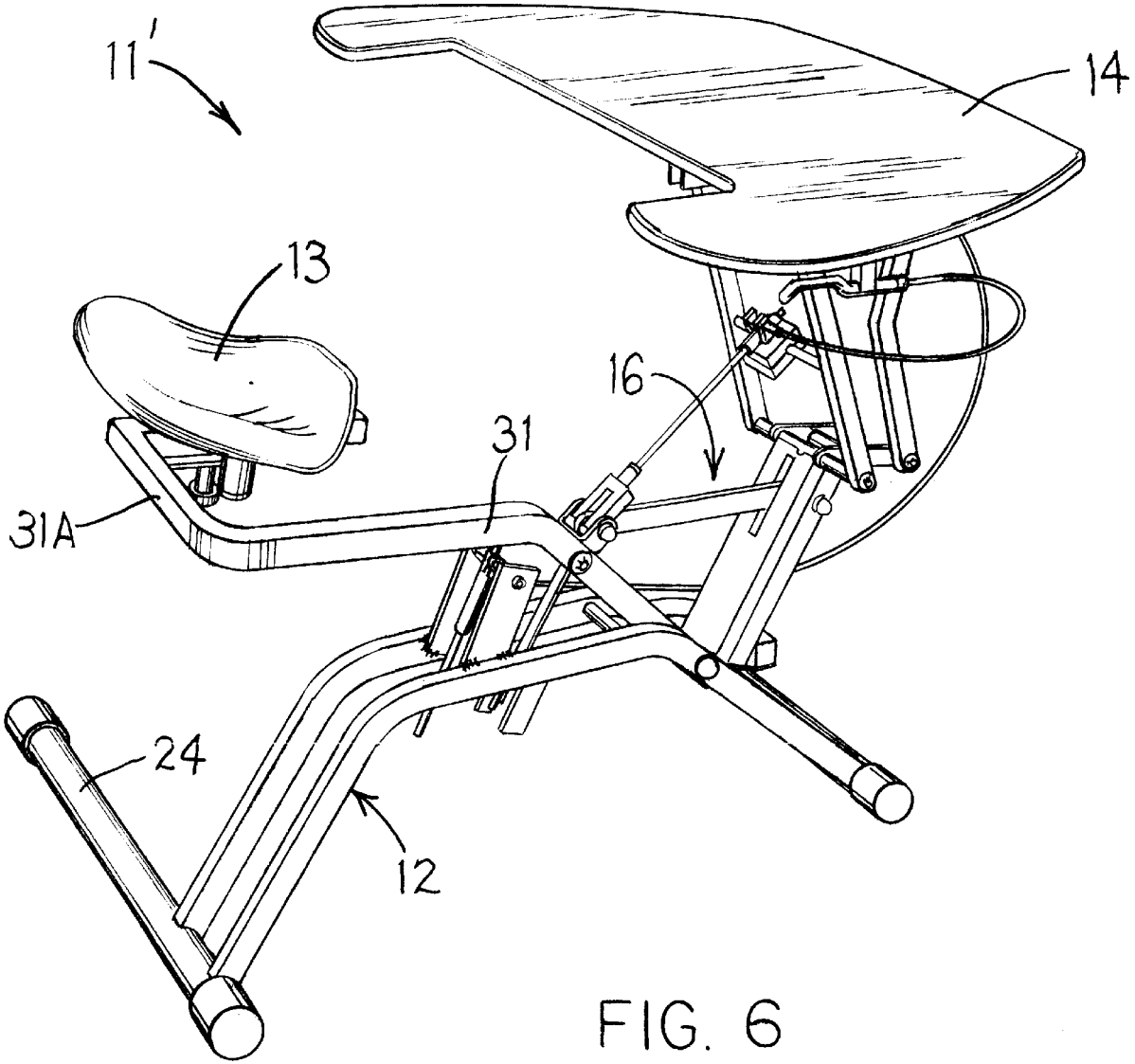
FIG. 6 is a perspective view similar to FIG. 1 and illustrating a second embodiment of the workstation according to the present invention.
Figure 7:
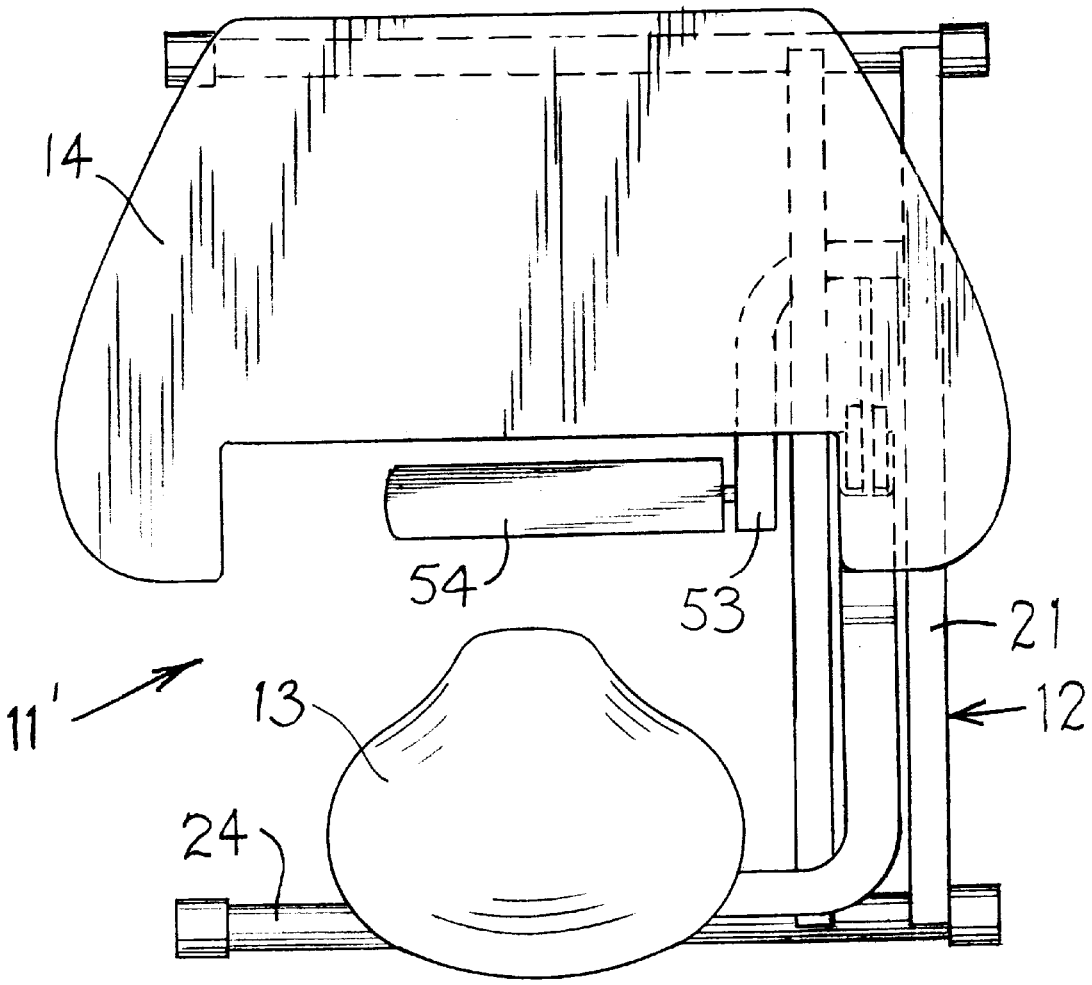
FIG. 7 is a top view of the embodiment shown in FIG. 6.

Referring now to FIGS. 6 and 7, there is illustrated a second embodiment of an operator-interactive workstation 11' according to the present invention. The embodiment of FIGS. 6 and 7 is structurally and functionally similar to the embodiment of FIGS. 1–5, and corresponding parts of FIGS. 6–7 have been designated by the same reference numerals utilized in FIGS. 1–5. The embodiment of FIGS. 6–7, however, has all of the operator-engaging parts, specifically the worksurface 14, the seat 13 and the foot-engaging supports 54, positioned solely on one side of the support frame 12 and movement connecting structure 16, whereby the operator can more readily access these operator-engaging parts of the workstation without having to straddle the frame or seat support lever such as in the FIGS. 1–5 embodiment.

More specifically, the seat support lever 31 adjacent the rearward end thereof has an extension 31A which is cantilevered sidewardly and horizontally in generally transverse relation with respect to the longitudinal vertical plane of the frame. This sideward extension 31A mounts thereon the seat 13, the latter being positioned sidewardly in displaced relation relative to the longitudinal beam 21 of the frame.

Similarly, the worksurface 14 is also cantilevered sidewardly relative to the supporting arrangement 41. That is, in this embodiment the brackets 46 fixed to the underside of the frame are disposed adjacent one side edge of the worksurface, and a majority of the worksurface is cantilevered horizontally sidewardly away from the underlying supporting arrangement 41 and its connection to the frame. Most of the region under the worksurface is thus free of obstructions.

The lower arm 53 associated with the foot support 54 is also cantilevered sidewardly in one direction away from the frame so that the foot support 54, it its entirety, is disposed sidewardly on one side of the frame, with the foot support 54 being generally aligned front-to-back with the seat 13 and the sidewardly cantilevered worksurface 14.

With the arrangement illustrated by the embodiment of FIGS. 6–7, an operator can readily access the region adjacent one side of the workstation 11', and can walk up to and readily sit on the seat 13 and position his/her feet on the support 54, and has convenient and unrestricted access to most of the region beneath the worksurface 14. All of the frame and motion connecting arrangement are thus generally disposed on one side of the operator, and hence the operator can more readily gain access to or egress from the workstation 11' without encountering obstructions defined by the workstation. The overall structure and operation of the embodiment of FIGS. 6–7, however, otherwise corresponds to the embodiment of FIGS. 1–5 so that further detailed description thereof is believed unnecessary.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An operator-interactive adjustable workstation, comprising:

a stationary support frame supporting the workstation on a floor;

a seat adapted for engagement with the buttocks of an operator;

a generally horizontally enlarged worksurface having a substantially enlarged and planar upper surface;

a motion connecting structure movably and controllingly connected to and between said frame, said seat and said worksurface for permitting said seat and worksurface to be simultaneously adjusted to multiple positions relative to said frame while simultaneously relatively moving said seat and worksurface to change the positional relationship therebetween, said motion connecting structure having a cantilevered seat support member pivotally connected to said frame, a worksurface support member movably connected to said frame, and a link member connected to both said seat and worksurface support member, said seat support member supporting said seat above a floor surface, and said worksurface support member supporting said worksurface;

an operator-interactive structure interconnected to said motion connecting structure for controlling position-adjusting movement of said seat and worksurface in response to an operator-applied controlling displacement, said operator-interactive structure including a support member which is engaged by the operator and to which the operator applies said controlling displacement; and a manually-releasable brake cooperating with the motion connecting structure for normally maintaining said motion connecting structure in a fixed positional relationship to define stationary positions for the seat and worksurface;

whereby, when said brake is manually released, said motion controlling structure can be moved in accordance with the controlling applied displacement by the operator on the support member to adjustably move the seat and worksurface to newly adjusted positions, whereupon said brake is reengaged to hold the seat and worksurface in the newly adjusted positions.

2. A workstation according to claim 1, including a manually-releasable adjusting structure cooperating with said motion connecting structure for permitting, when released, the position of the worksurface to be movably adjusted without effecting movement of the seat.

3. The workstation according to claim 1, wherein said motion connection structure includes means for moving said worksurface relative to said seat.

4. The workstation according to claim 1, wherein said support member is movably supported on said frame, receives an operator's foot thereon and moves said operator-interactive structure in response to release of said brake and receipt of the operator applied controlling displacement from the operator's foot to adjust said worksurface and seat to newly adjusted positions.

5. An operator-interactive adjustable workstation, comprising:

a stationary support frame;

a seat adapted for engagement with the buttocks of an operator;

a generally horizontally enlarged worksurface having a substantially enlarged and planar upper surface;

a motion connecting structure connected between said frame, said seat and said worksurface for permitting said seat and worksurface to be adjusted to multiple positions relative to said frame;

an operator-interactive structure interconnected to said motion connecting structure for controlling position-adjusting movement of said seat and worksurface in response to an operator-imposed controlling force, said operator-interactive structure including an operator engagement member which is engaged by the operator and to which the operator imposes said controlling force;

said motion connecting structure including a first support member which is movably mounted on said frame and which mounts said seat thereon, a second support member which is movably mounted on said frame and carries said worksurface thereon, a first connecting link which is movably connected between said first and second support members, and a second connecting link movably connected between said first support member and said operator-interactive structure;

a manually-releasable brake cooperating with the motion connecting structure for normally maintaining said motion connecting structure in a fixed positional relationship to define stationary positions for the seat and worksurface;

whereby, when said brake is manually released, said motion controlling structure can be moved in accordance with the controlling force imposed by the operator on the operator engagement member to adjustably move the seat and worksurface to desired adjusted positions, whereupon said brake is reengaged to hold the seat and worksurface in a newly adjusted position.

6. The workstation according to claim 5, wherein said motion connecting structure includes means for simultaneously adjusting said seat and said worksurface relative to said frame.

7. A workstation according to claim 5, wherein said operator-interactive structure is movably mounted on said frame.

8. A workstation according to claim 7, wherein said first and second support members are mounted on said support frame for pivoting movement about first and second generally horizontal axes so that said first and second support members are vertically swingable within generally parallel vertical planes, and wherein said operator-interactive structure includes a control arm which is vertically swingably supported on said frame for swinging movement about a generally third horizontal axis which is spaced from said first and second axes.

9. A workstation according to claim 8, wherein said brake is releasably connected between said first support member and said frame, said brake engagement preventing movement of said seat support member and said operator-interactive control arm.

10. A workstation according to claim 9, including a second position adjusting brake associated with said first control link for permitting said worksurface to be adjusted to a new position relative to said seat when said second brake is released.

11. An operator-interactive adjustable workstation, comprising:

a stationary support frame;

a seat adapted for engagement with the buttocks of an operator, the seat having multiple positions;

a generally horizontally enlarged worksurface having a substantially enlarged and planar upper surface, the worksurface having multiple positions;

a motion connecting structure connected between said frame, said seat and said worksurface for permitting the positions of said seat and worksurface to be adjusted relative to said frame;

an operator-interactive structure interconnected to said motion connecting structure for controlling position-adjusting movement of said seat and worksurface in response to an operator-imposed controlling force, said operator-interactive structure including a support member which is engaged by the operator and to which the operator imposes said controlling force;

a manually-releasable brake cooperating with the motion connecting structure for normally maintaining said motion connecting structure in a fixed positional relationship to define stationary positions for the seat and worksurface;

said operator-interactive structure including a control member which is movably supported on said frame and which mounts thereon the support member which is adapted for engagement with the foot of the operator; and whereby when the brake is released the operator's foot applies the controlling force to the support member to effect movement of the support member and of the control member to cause corresponding movements of the seat and worksurface, whereupon said brake is reengaged to hold the seat and worksurface in a newly adjusted position.

12. The workstation according to claim 11, wherein said motion connecting structure includes means for simultaneously adjusting the positions of said seat and worksurface relative to said frame.

13. A workstation according to claim 11, including a manually-releasable adjusting structure cooperating with said motion connecting structure for permitting, when released, the position of the worksurface to be movably adjusted without effecting movement of the seat.

14. An operator-interactive adjustable workstation, comprising:

a stationary support frame;

a seat adapted for engagement with the buttocks of an operator;

a generally horizontally enlarged worksurface having a substantially enlarged and planar upper surface;

a motion connecting structure connected between said frame, said seat and said worksurface for permitting said seat and worksurface to be simultaneously adjusted to multiple positions relative to said frame;

an operator-interactive structure interconnected to said motion connecting structure for controlling position-adjusting movement of said seat and worksurface in response to an operator-imposed controlling force, said operator-interactive structure including a support member which is engaged by the operator and to which the operator imposes said controlling force;

a manually-releasable first brake cooperating with the motion connecting structure for normally maintaining said motion connecting structure in a fixed positional relationship to define stationary positions for the seat and worksurface whereby, when said first brake is manually released, said motion controlling structure can be moved in accordance with the controlling force imposed by the operator on the support member to adjustably move the seat and worksurface to newly adjusted positions, whereupon said first brake is reengaged to hold the seat and worksurface in the newly adjusted positions; and said motion connecting structure includes a second brake for maintaining said worksurface in a fixed positional relationship, whereby, when said second brake is released, said worksurface can be moved relative to said seat with said seat being stationarily positioned.

* * * * *

UNITED STATES PATENT AND TRADEMARK OFFICE

CERTIFICATE OF CORRECTION

PATENT NO. : 5,961,179
DATED : October 5, 1999
INVENTOR(S) : Perry L. Dixon, et. al.

It is certified that error appears in the above-identified patent and that said Letters Patent is hereby corrected as shown below:

Column 9, line 52, change "member" (first occurrence) to members--.

Signed and Sealed this

Fourteenth Day of November, 2000

*Attest:*

Q. TODD DICKINSON

*Attesting Officer*

*Director of Patents and Trademarks*